US011807425B2

(12) United States Patent
Faragher

(10) Patent No.: US 11,807,425 B2
(45) Date of Patent: Nov. 7, 2023

(54) CHILD-RESISTANT CLOSURE SYSTEM

(71) Applicant: Obrist Closures Switzerland GMBH, Reinach (CH)

(72) Inventor: Stephen Faragher, Norfolk (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 1450 days.

(21) Appl. No.: 16/070,734

(22) PCT Filed: Jan. 19, 2017

(86) PCT No.: PCT/EP2017/051120

§ 371 (c)(1),
(2) Date: Jul. 17, 2018

(87) PCT Pub. No.: WO2017/125515

PCT Pub. Date: Jul. 27, 2017

(65) Prior Publication Data

US 2019/0023461 A1 Jan. 24, 2019

(30) Foreign Application Priority Data

Jan. 19, 2016 (GB) ..... 1600930

(51) Int. Cl.
*B65D 43/00* (2006.01)
*B65D 43/16* (2006.01)

(52) U.S. Cl.
CPC ..... *B65D 43/169* (2013.01); *B65D 43/16* (2013.01); *B65D 2215/02* (2013.01); *B65D 2251/1025* (2013.01)

(58) Field of Classification Search
CPC ..... B65D 2215/02; B65D 2251/1025; B65D 43/169
USPC ..... 206/1.5; 220/263
See application file for complete search history.

(56) References Cited

U.S. PATENT DOCUMENTS 2,936,189 A * 5/1960 Pearson ..... E05B 65/0014 220/326
3,984,021 A 10/1976 Uhlig
4,854,448 A * 8/1989 Hair, II ..... E05B 65/0014 220/326

(Continued)

FOREIGN PATENT DOCUMENTS

GB 2519205 A 4/2015
WO WO9748615 A1 12/1997
WO WO9824988 A1 6/1998

OTHER PUBLICATIONS

GB Patents Directorate, Search Report for GB 1600930.0, published Feb. 23, 2016.

(Continued)

*Primary Examiner* — Steven A. Reynolds
(74) *Attorney, Agent, or Firm* — James F. Lea, III; Gable Gotwals

(57) ABSTRACT

A child-resistant closure (10) is provided and comprises a lid (20) and a base (15). The closure comprises child-resistant locking means for preventing unwanted opening of the lid. The locking means comprising two locking members (23A, 23B) carried on or by a respective release member, the locking members engaging the base to prevent opening of the lid. The release members are movable towards each other to disengage the locking members from the base.

7 Claims, 17 Drawing Sheets

(56) References Cited

U.S. PATENT DOCUMENTS

| | | | | |
|---|---|---|---|---|
| 5,353,946 | A * | 10/1994 | Behrend | B65D 43/169 220/326 |
| 5,794,803 | A | 8/1998 | Sprick | |
| 5,979,688 | A * | 11/1999 | Stodd | B65D 51/1677 215/253 |
| 6,036,036 | A | 3/2000 | Bilani et al. | |
| 10,577,156 | B2 * | 3/2020 | Dagnelie | B65D 43/22 |
| 2003/0201283 | A1 | 10/2003 | Branson et al. | |
| 2007/0278125 | A1 * | 12/2007 | Gelardi | B65D 50/045 206/533 |
| 2009/0314856 | A1 | 12/2009 | Romanov et al. | |
| 2010/0320168 | A1 | 12/2010 | Bull | |
| 2011/0204087 | A1 * | 8/2011 | Kopulos | B65D 21/0219 220/810 |
| 2011/0284541 | A1 | 11/2011 | Webster et al. | |
| 2014/0151388 | A1 | 6/2014 | Culeron et al. | |
| 2014/0284333 | A1 * | 9/2014 | Poon | B65D 39/12 220/318 |
| 2016/0229599 | A1 * | 8/2016 | Rogers | B65D 51/20 |
| 2017/0137185 | A1 * | 5/2017 | Jones | B65D 43/0204 |
| 2018/0134467 | A1 * | 5/2018 | Dagnelie | B65B 7/2842 |

OTHER PUBLICATIONS

EPO, International Search Report for PCT/EP2017/051120, published Mar. 21, 2017.

* cited by examiner

Opening the CR feature:

1) the mechanism is "pinched" using thumb and fingers to disengage the CR features 2) The lid can then be lifted with the mechanism still "pinched" to open the pack

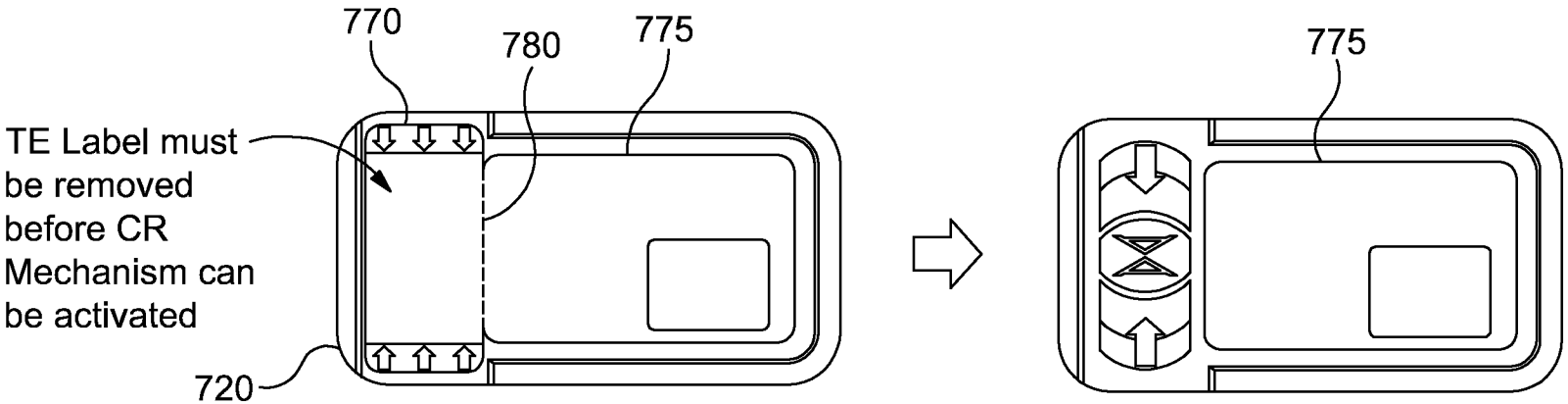
Figure 31
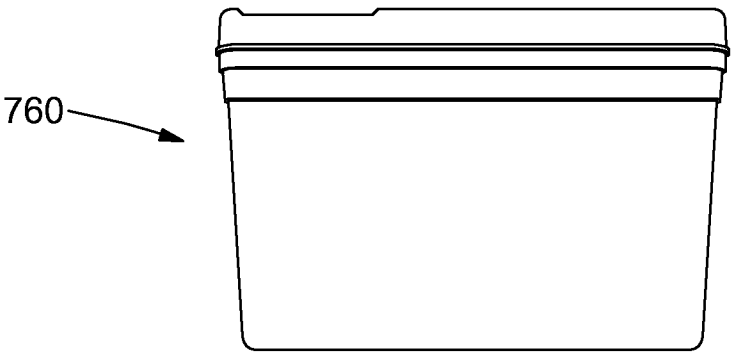
Figure 32
Figure 33
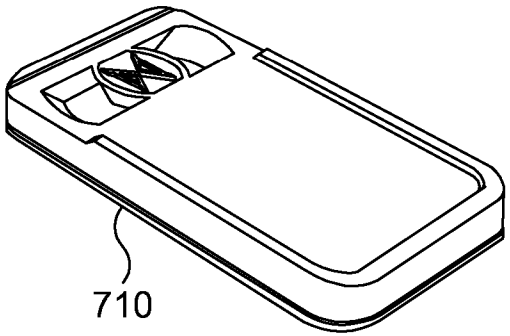
Figure 34

CHILD-RESISTANT CLOSURE SYSTEM

The present invention relates generally to a closure system and particularly to a child-resistant closure system for reducing the risk of children ingesting dangerous items.

An aspect of the present invention provides a child-resistant closure comprising a lid and a base, the closure comprising child-resistant locking means for preventing unwanted opening of the lid, the locking means comprising two locking members carried on or by a respective release member, the locking members engaging the base to prevent opening of the lid, the release members being movable towards each other to disengage the locking members from the base.

The locking members may comprise a pair of lugs.

The locking members may be released by squeezing/pressing the release members towards each other.

A further aspect provides a child-resistant wide-mouth container closure comprising a lid and a base, the closure comprising locking means for preventing the lid being opened, the locking means comprising a pair of locking lugs carried on or by a pair of pinchable release members, the lugs engaging the base to prevent opening of the lid, the release members being pinchable together to disengage the lugs from the base.

The lid may comprise a finger recess adjacent either or both of the release members.

The lid and base may be hingedly connected together.

A further aspect provides a container comprising a tub and a closure for the closing the tub, the closure comprising a base and a lid, the base being attachable to the tub and the lid being hingedly connected to the lid, the closure comprising child-resistant locking means for preventing unwanted opening of the lid.

The container may be generally oblong.

The tub and the lid may be generally oblong.

The lid may be hinged to the base along a short side thereof. Alternatively the lid may be hinged to the base along a long side thereof.

The locking means may be provided on or by the lid and comprise a pair of locking lugs carried on or by a pair of release members, the lugs engaging the base to prevent opening of the lid, the release members being pinchable towards each other to disengage the lugs from the base.

The lid may be non-removably connected to the tub. In some embodiments the lid is formed to include a rim, the rim being fastenable to the rim of the tub.

The lid may comprise a finger recess adjacent either or both sides of two opposed release members. In some embodiments a recess is provided on one side, the other side being open so that both members can be accessed by a user's digits.

Container formed in accordance with the present invention may stackable with one or more other such containers.

The locking means may be provided at or towards one end of the lid. In some embodiments the locking means are provided at or towards the front of a lid, for example generally opposite a hinge.

The locking mechanism may be initially covered by a removable sticker, label or the like. This could serve as a tamper-evident feature. In some embodiments the sticker/label removal is irreversible i.e. it cannot be replaced, or is damaged in the process of removal so as to be visually distinct and cannot be returned to its original state.

A further aspect provides a child-resistant household cleaning product storage container including a lid movable between a closed, locked position and an open, unlocked position whereby to prevent unwanted access to the contents of the container.

The container may be a cleaning product capsule box closed by the lid.

The container may be a cleaning product tablet box closed by the lid.

The lid may be locked in the closed position by locking means including two parts and which is unlocked by relative approach of the two parts.

The parts may be, for example, pinched, squeezed or pressed towards each other to overcome the locking means. In some embodiments, for example, the parts are configured and arranged so that in use one or more fingers together with the thumb of a user is the most convenient way to unlock the lid.

The locking means may comprise locking lugs which are engaged in the locked position and are disengagable by approach of the two parts.

The lid may comprise a base part and a top part, the base being attached or attachable to a container and the lid being lockable to the base.

The lid may be hingedly attached to the base, for example with a film hinge, butterfly hinge, straps or the like.

A further aspect provides a child-resistant household cleaning product lid which is attached or attachable to a cleaning product container, the lid being movable from a locked, closed position to an unlocked, open position to prevent unwanted access to the container.

A further aspect provides a child-resistant lid comprising locking means including two parts, the lid being unlocked by relative approach of the two parts.

The two parts may be pinchable together.

The present invention also provides a lid as described herein in combination with a container.

According to a further aspect of the present invention there is provided a child-resistant household cleaning product storage container including a lid movable between a closed, locked position and an open, unlocked position whereby to prevent unwanted access to the contents of the container.

The container may be a cleaning product capsule box closed by the lid. For example a detergent capsule, such as a laundry detergent capsule or a dishwasher capsule.

The container may be a cleaning product tablet box closed by the lid. For example a laundry detergent tablet or a dishwasher tablet.

The lid may be locked in the closed position by locking means including two parts and the lid may be unlocked by relative approach of the two parts, for example pinching or pressing the parts towards each other to overcome the locking means.

The locking means may comprise locking lugs which are engaged in the locked position and are disengagable by approach of the two parts.

The lid may comprise a base part and a top part, the base being attached or attachable to a container and the lid being lockable to the base.

The lid may be hingedly attached to the base, for example by a film hinge.

The present invention also provides a child-resistant wide-mouth container closure comprising a lid and a base, the closure comprising locking means for preventing the lid being opened, the locking means comprising a pair of locking lugs carried on or by a pair of pinching members, the lugs engaging the base to prevent opening of the lid, the members being pinchable together to disengage the lugs from the base.

The present invention also provides a child-resistant household cleaning product lid which is attached or attachable to a cleaning product container, the lid being movable from a locked, closed position to an unlocked, open position to prevent unwanted access to the container.

The present invention also provides a child-resistant lid comprising locking means including two parts, the lid being unlocked by relative approach of the two parts.

The two parts may be pinchable together.

The present invention also provides a lid as described herein forming part of and/or in combination with a container as described herein.

In some embodiments and embodiments the closure is generally rectangular. In other embodiments other shapes are possible, such as circular or ellipsoidal.

The closure system may be used as part of a medicine box/pot i.e. a container either for generally containing medicine, or a container where a medicine course is placed in and used to provide a daily, weekly etc. course of single or multiple medicine types such as tablets.

The present invention also provides a child-resistant closure comprising a lid and a base, the closure comprising locking means for preventing the lid being opened, the locking means comprising a pair of locking lugs carried on or by a pair of pinching members, the lugs engaging the base to prevent opening of the lid, the members being pinchable together to disengage the lugs from the base.

The base may be connected or connectable to a container.

The lid and base may be hingedly connected together.

In some aspects and embodiments the closure is a flip-top closure (with a base and a hinged lid), such as a flip-top dispensing closure, incorporating a pinch-to-open child-resistant feature.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings.

BRIEF DESCRIPTION OF THE DRAWINGS

FIG. 31 shows a plan view of a closure with a tamper-evident label;

FIG. 32 shows the closure of FIG. 31 attached to a container;

FIG. 33 shows a plan view the closure of FIG. 31 with the label removed;

FIG. 34 shows a perspective view of the closure of FIG. 33;

Figure 1:
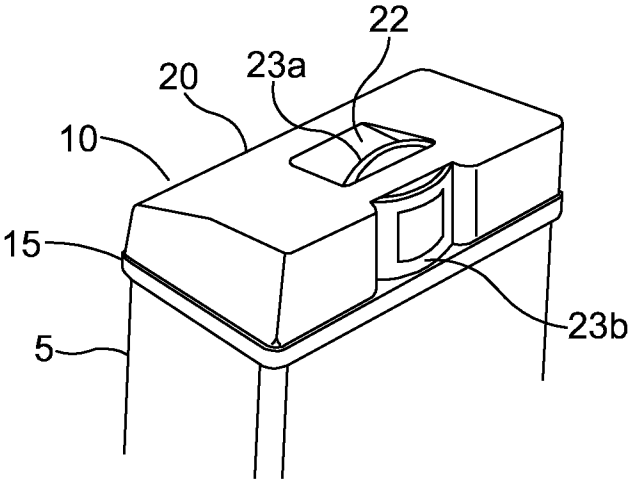
FIG. 1 shows a closure attached to a wide mouth container.
Figure 2:
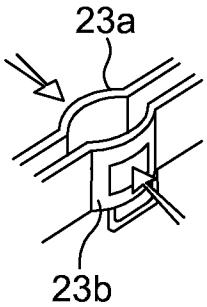
FIG. 2 shows a magnified view of pinching members forming part of the closure.
Figure 3:
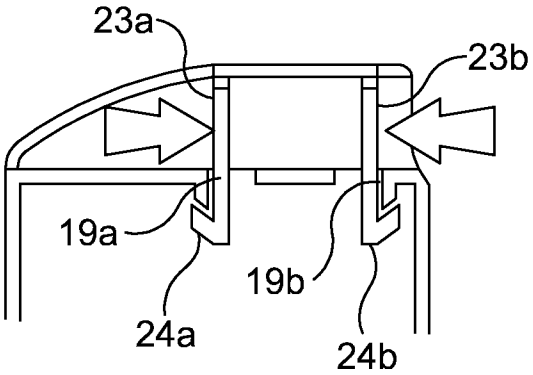
FIG. 3 shows a section of the closure of FIG. 1 attached to the container.
Figure 4:
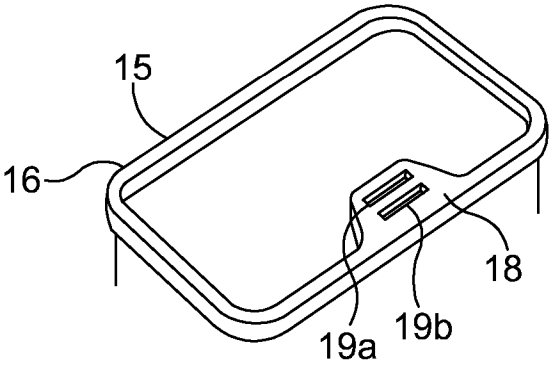
FIG. 4 shows a base forming part of the closure of FIG. 1.
Figure 5:
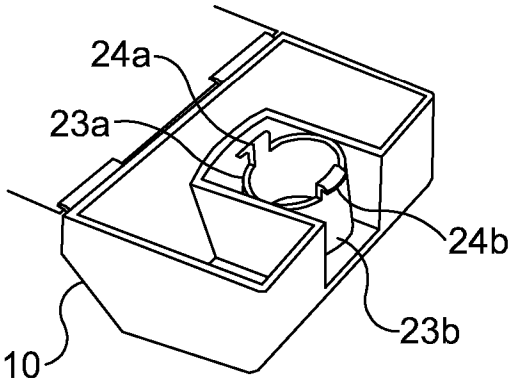
FIG. 5 shows the underside of a lid forming part of the closure of FIG. 1.
Figure 6:
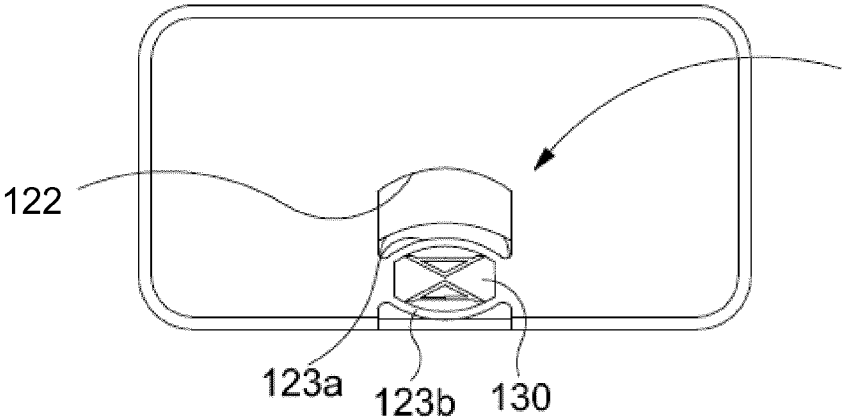
FIG. 6 shows a plan view of a closure in a closed position.
Figure 7:
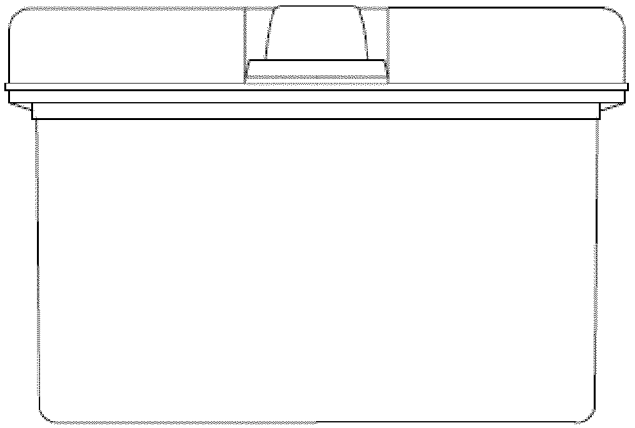
FIG. 7 shows a side view of the closure of FIG. 7 attached to a container.
Figure 8:
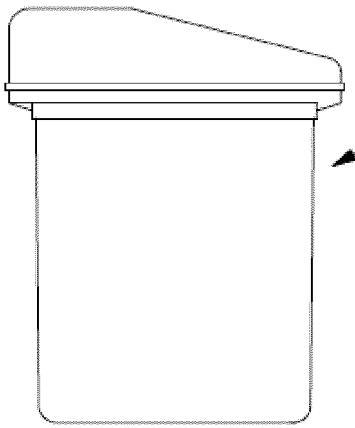
FIG. 8 shows a side view of FIG. 7.
Figure 9:
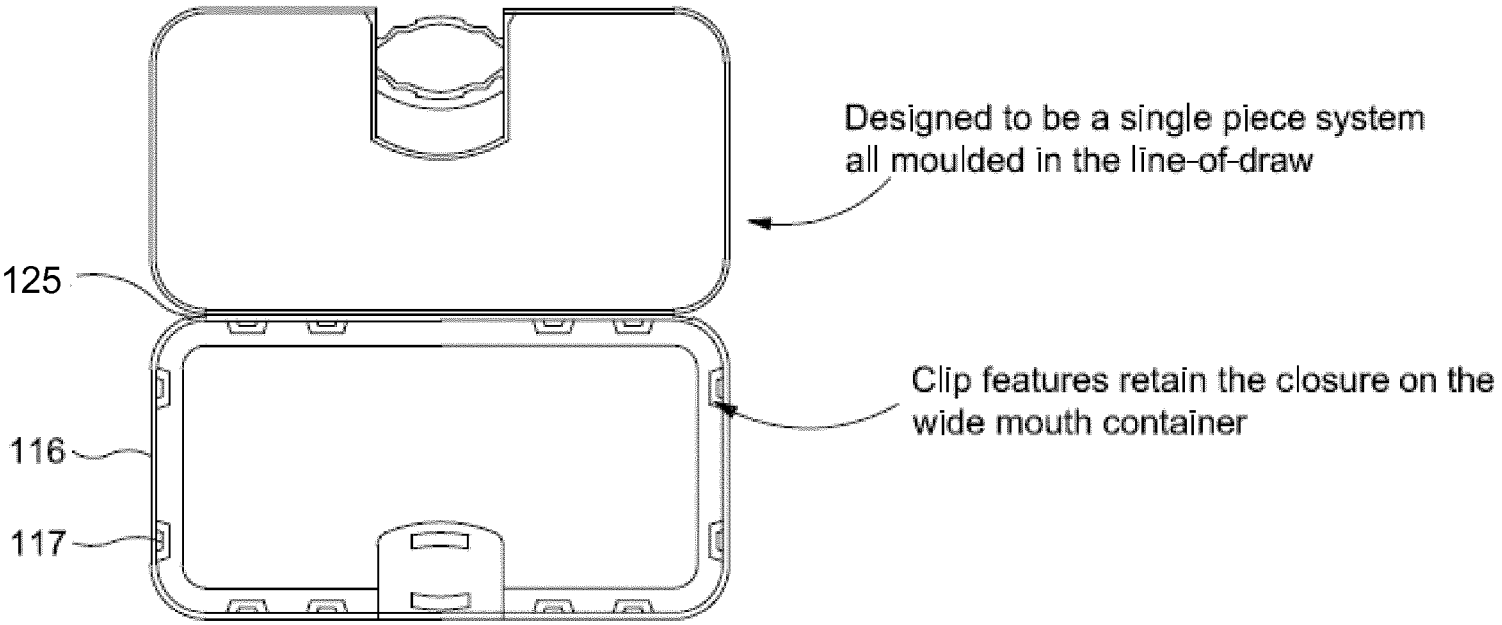
FIG. 9 shows the closure of FIG. 6 in an open position.
Figure 10:
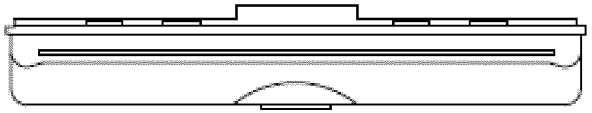
FIG. 10 shows a front view of the closure of FIG. 9.
Figure 11:
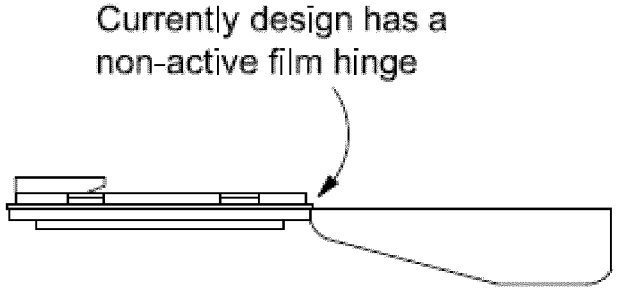
FIG. 11 shows a side view of the closure of FIG. 10.
Figure 12:
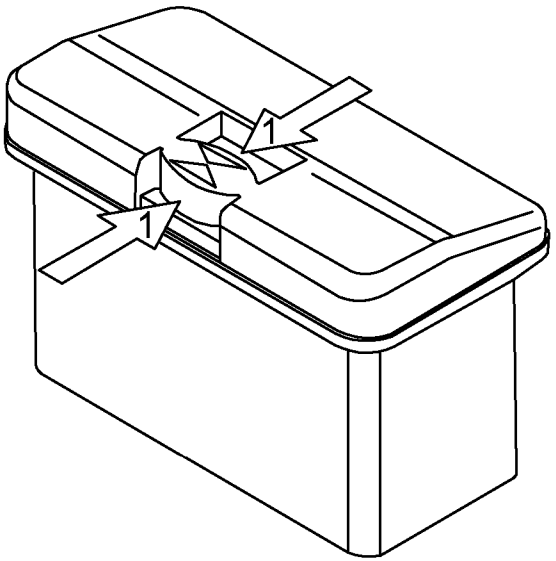
FIG. 12 shows the closure of FIGS. 6 to 11 in a locked position.
Figure 13:
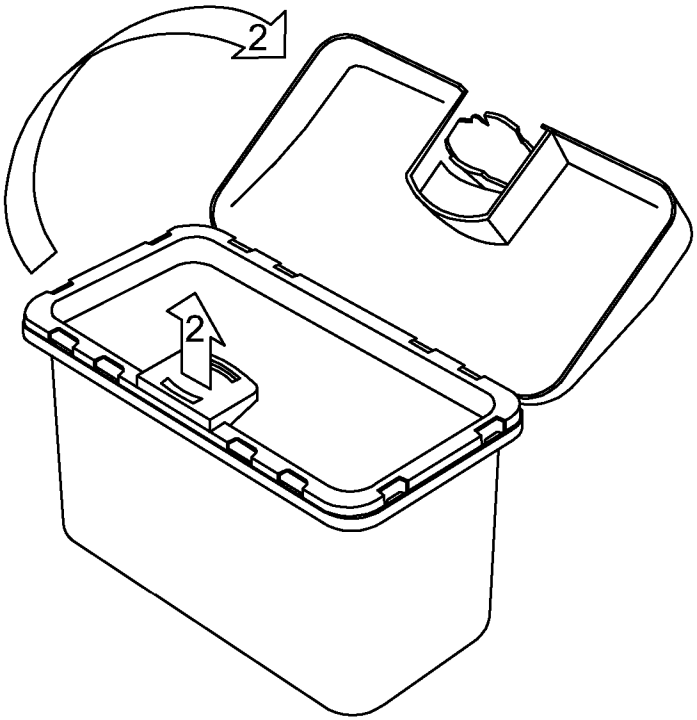
FIG. 13 shows the closure of FIG. 12 in an unlocked position.

In the following description, all orientational terms, such as upper, lower, radially and axially, are used in relation to the drawings and should not be interpreted as limiting on the invention or its connection to a closure.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed and as well as individual embodiments the invention is intended to cover combinations of those embodiments as well. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent; however, the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

In general terms the closure system showing in FIGS. 1 to 5 comprises a closure 10 which is attachable to a wide mouth container, in this embodiment a box-like container 5.

The closure 10 comprises a base 15 and a lid 20.

The base 15 includes a generally rectangular frame 16 which can be clipped or otherwise retained on the container.

The base 15 includes a locking platform 18 including a pair of arcuate slots 19*a*, 19*b*.

The lid 20 includes a generally rectangular top plate 21 with a frontal recess 22 in which is provided a pair of resilient, arcuate pinching members 23*a*, 23*b*.

The pinching members 23*a*, 23*b* each carry a locking lug 24*a*. 24*b*. In the closed position of the closure the lugs 24*a*, 24*b* engage in the slots 19*a*, 19*b* and prevent the lid from being removed/opened.

To release the lid the members 23*a*, 23*b* must be pinched together and then the lugs can withdraw through the slots.

FIGS. 6 to 16 show a similar system.

In this embodiment the base frame 116 is provided with a plurality of clips 117 for clipping the closure onto the container. In addition the pinching members 123*a*, 123*b* are formed as a single piece and connected by an ellipsoidal top plate 130. Also, the 115 base and lid 120 are attached together by a non-active film hinge 125.

Figure 15:
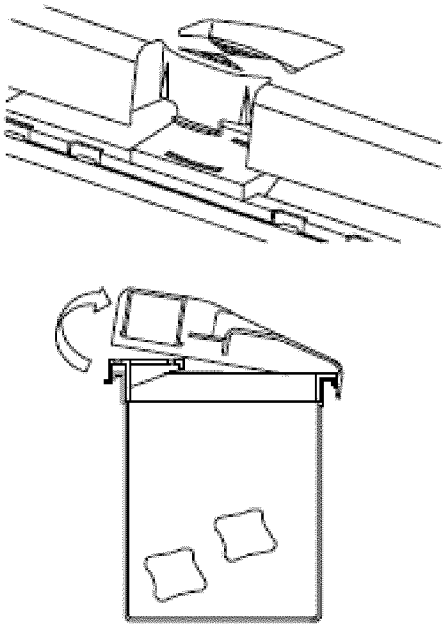
FIG. 15 shows the closure of FIG. 14 in an unlocked position and with a lid partially opened.
Figure 14:
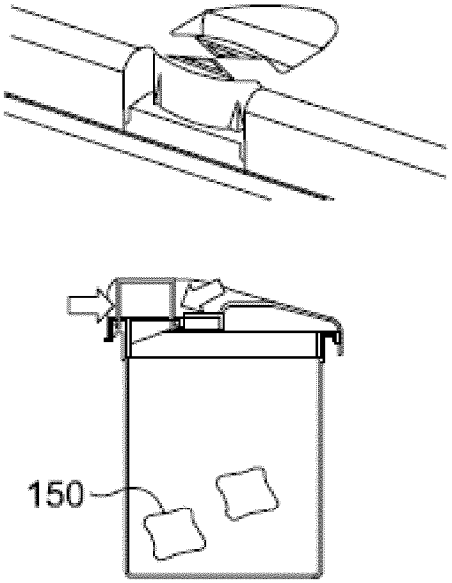
FIG. 14 shows the closure and container of FIGS. 6 to 13, with the closure in a locked position and with container contents shown.
Figure 16:
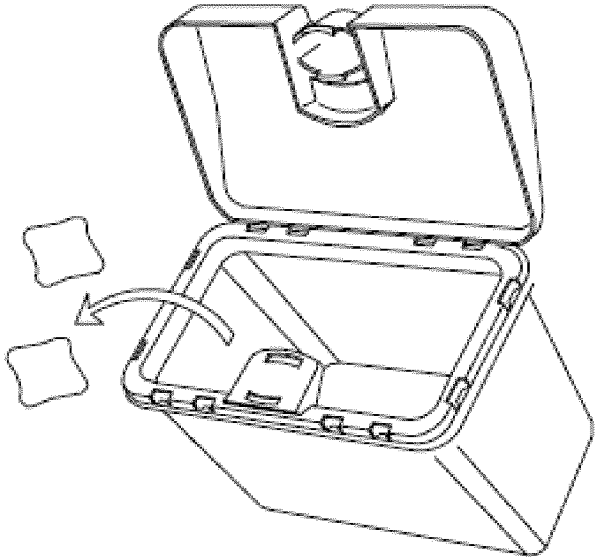
FIG. 16 shows the closure of FIG. 15 with a lid in a further opened position.

FIGS. 14 to 16 show the container in use protecting laundry detergent capsules 150

Figure 17:
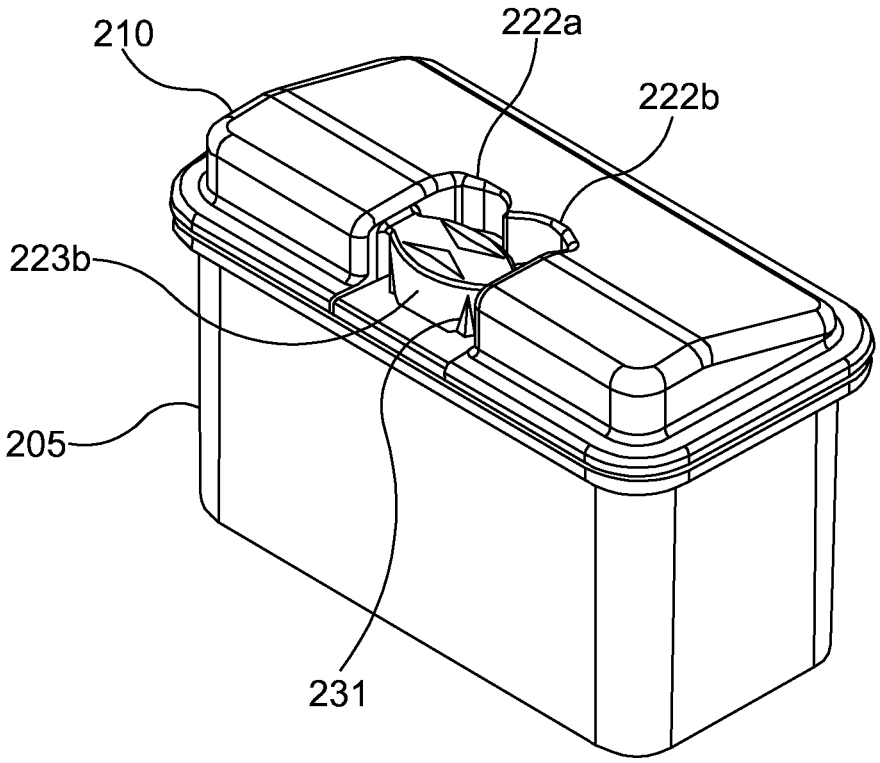
FIGS. 17 to 19 show a closure system similar to that shown in FIGS. 6 to 16.
Figure 18:
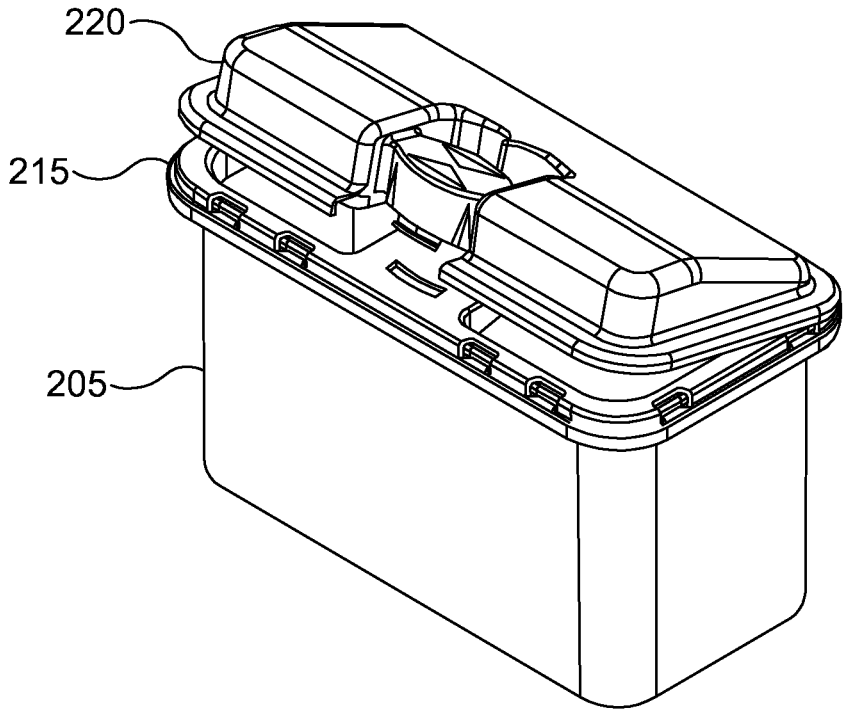
Figure 19:
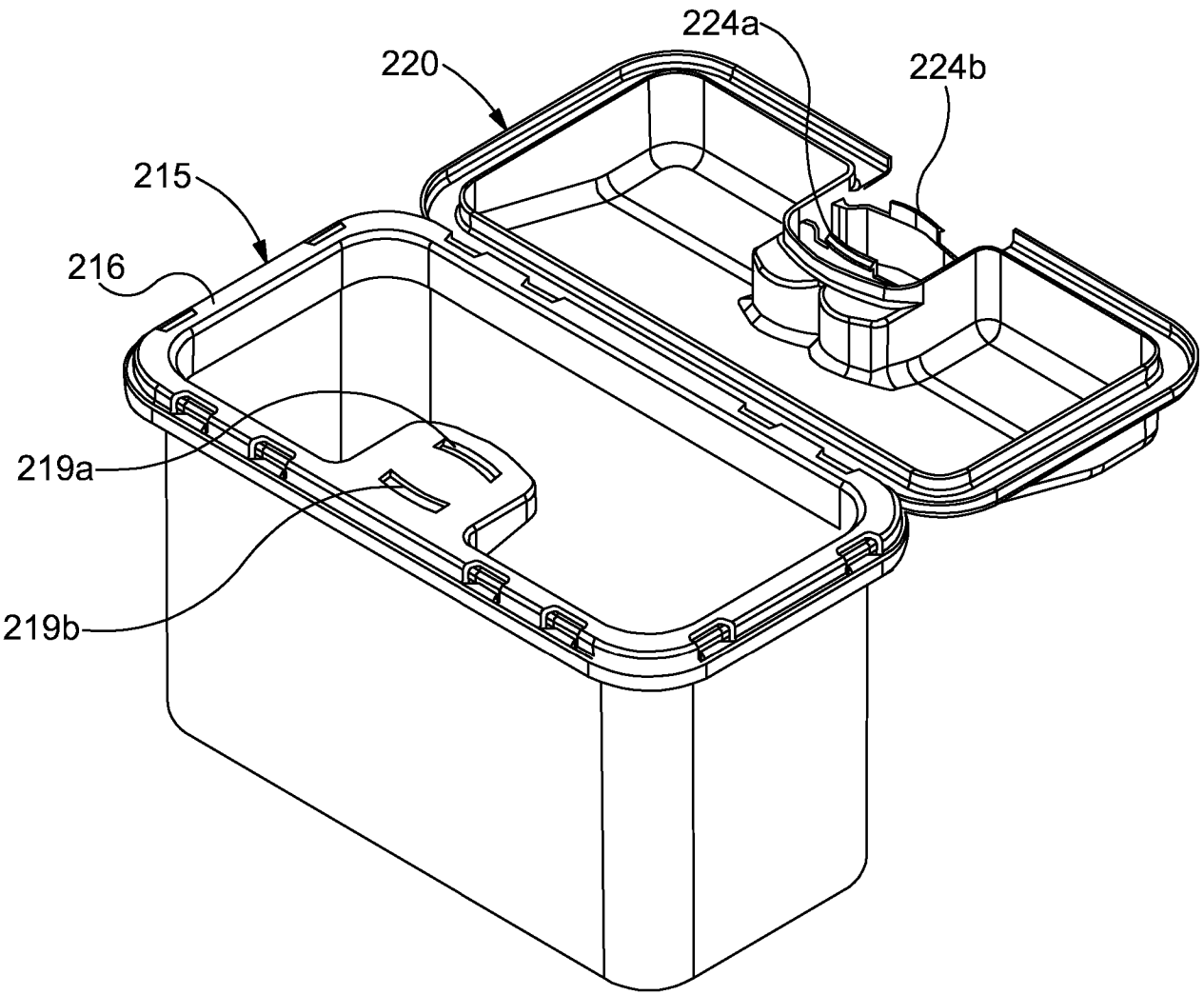

FIGS. 17 to 19 show a system which is similar to that shown in FIGS. 6 to 16. In this embodiment the pinching members 223*a*, 223*b* each have a pair of lateral force insulating links 231. The links restrict lateral spreading of forces when the members are pinched towards each other, thereby concentrating the inward deflection. The recess 222 includes two finger recesses 222*a*, 222*b* for receiving a user's index finger and middle finger in use to pinch the member 223*a*, whilst their thumb pinches the member 223*b*.

Figure 20:
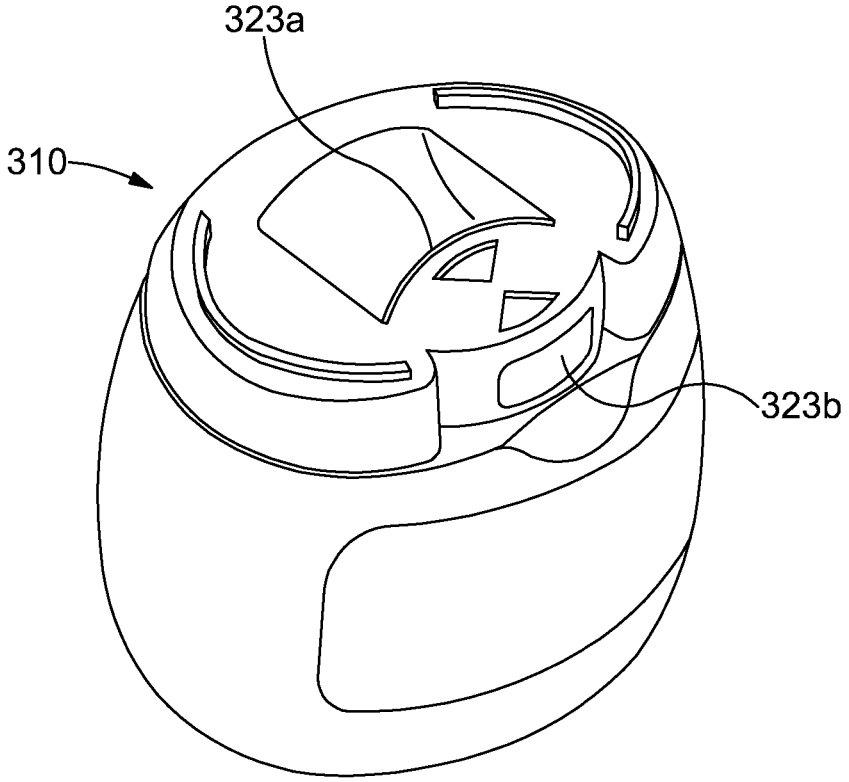
FIG. 20 shows a child-resistant closure which is fitted directly onto a container.

FIG. 20 shows a child-resistant closure 310 formed in accordance with the present invention. The closure may include a base and a lid or may fit directly onto a container.

Figure 21:
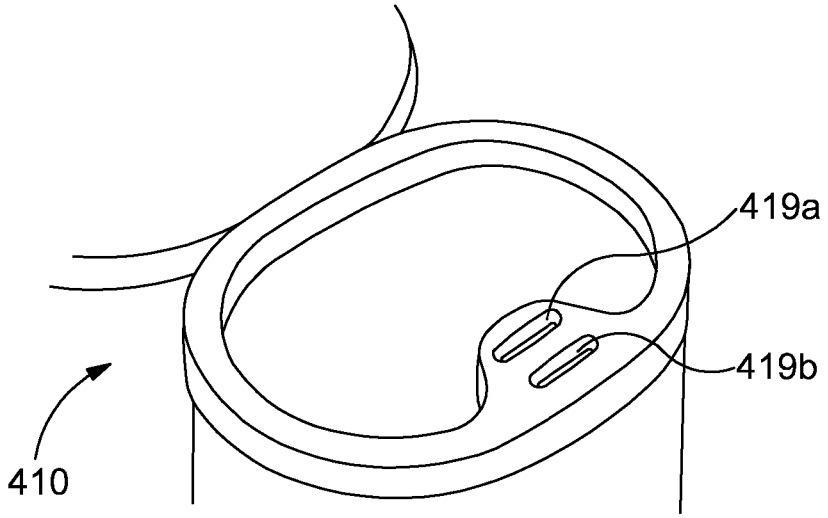
FIG. 21 shows a generally oval closure.

FIG. 21 shows a closure 410 formed according to a further embodiment. In this embodiment the closure is generally oval.

Figure 22:
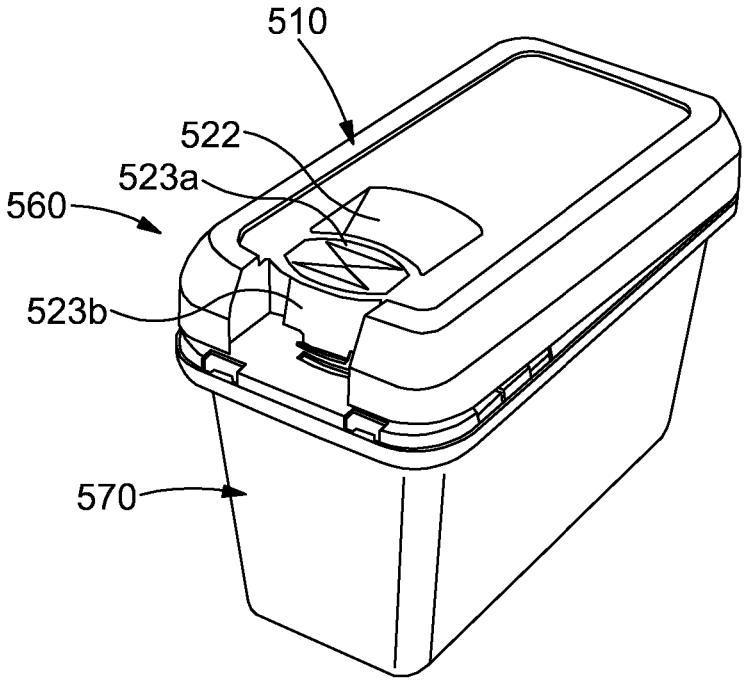
FIGS. 22 and 23 show a container pack including a closure connected to a tub-like container.
Figure 23:
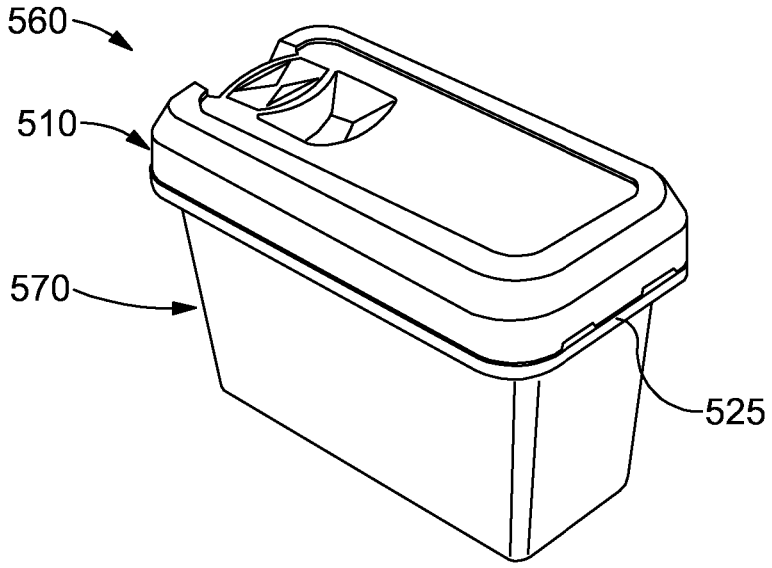

FIGS. 22 and 23 show a container pack generally indicated 560 and including a closure 510 connected to a container 570 (which in this embodiment is a tub-like container).

The pack 560 is generally oblong, meaning that the closure 510 has two shorter sides and two longer sides.

The closure 510 includes a base 515 which is non-removably (in normal use) connected onto the container so that it cannot easily be removed, and a lid 520 connected to the base by a hinge 525 along one of the shorter sides. This edge hinging allows for side opening.

A child-resistant mechanism is provided by the lid at the shorter side opposite the hinge.

Figure 24:
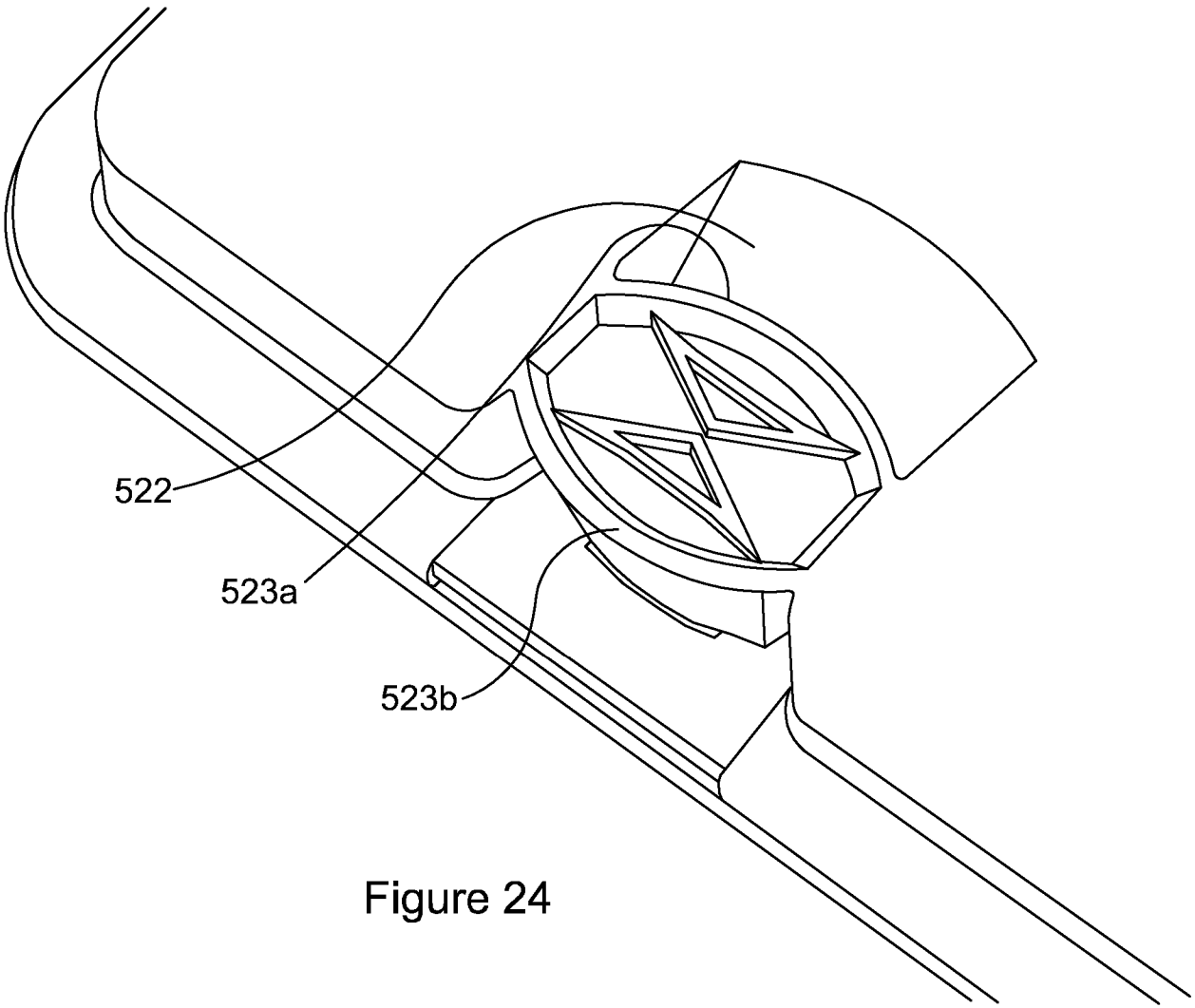
FIG. 24 shows a magnified view of a child-resistant pinching zone forming part of the closure of FIGS. 22 and 23.

The mechanism (see also FIG. 24) comprises a pair of opposed squeeze members 523*a*, 523*b*. The member 523*b* is at the front of the lid and can be accessed directly. Adjacent the member 523*a* a finger recess 522 is provided for access.

Figure 25:
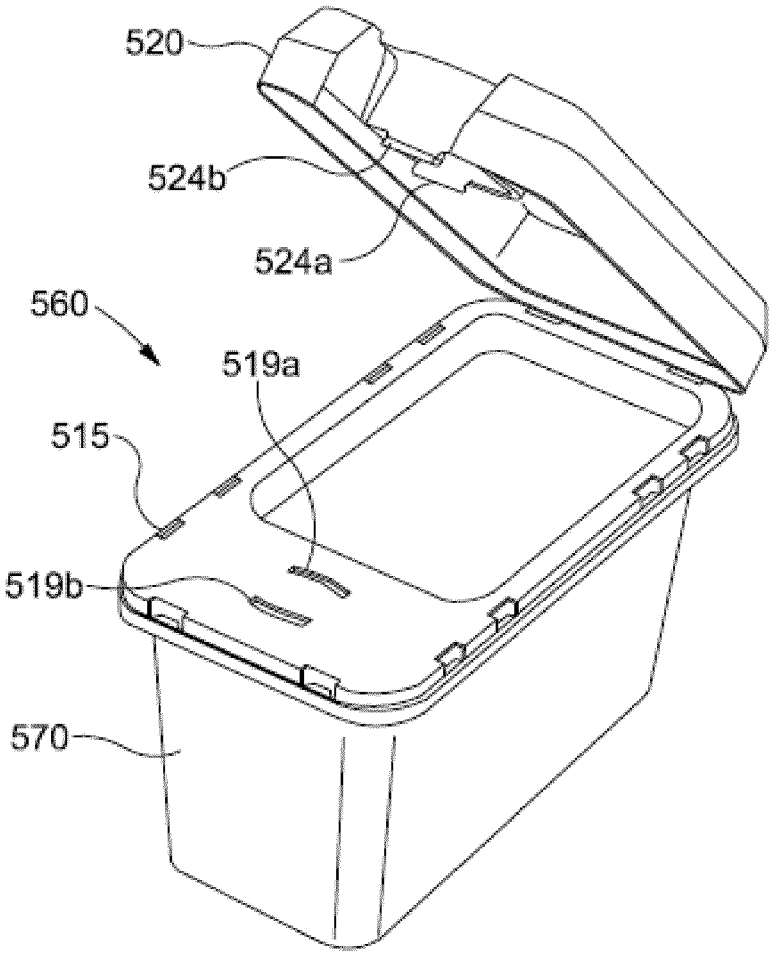
FIG. 25 shows the pack of FIGS. 22 and 23 with a lid in a partially opened position.
Figure 26:
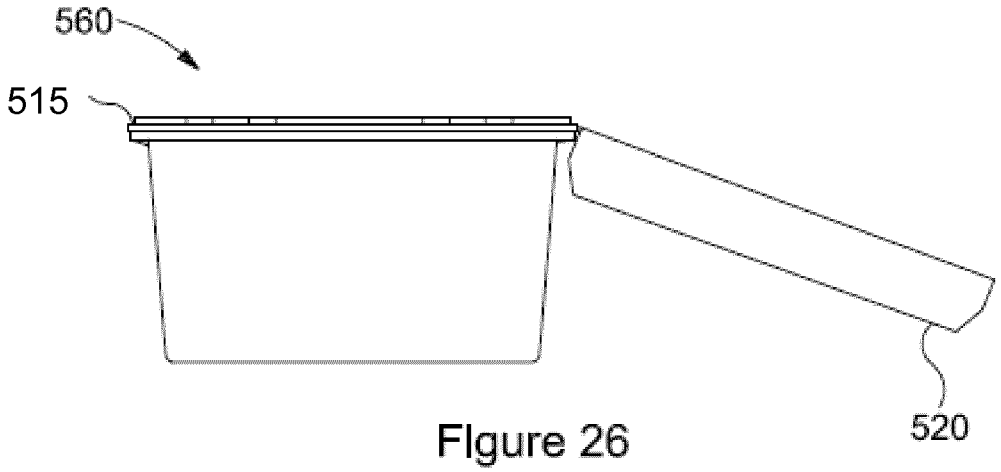
FIG. 26 shows the pack of FIG. 25 with the lid in a fully open position.
Figure 27:
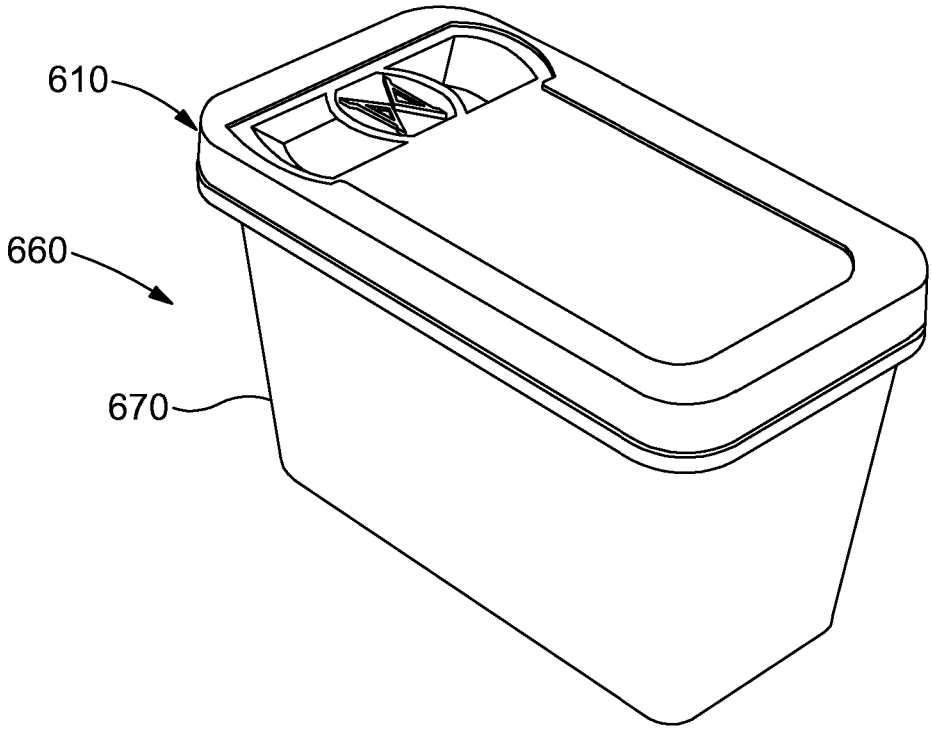
FIGS. 27 to 30 show a pack similar the pack of Figures to FIGS. 22 to 26.
Figure 28:
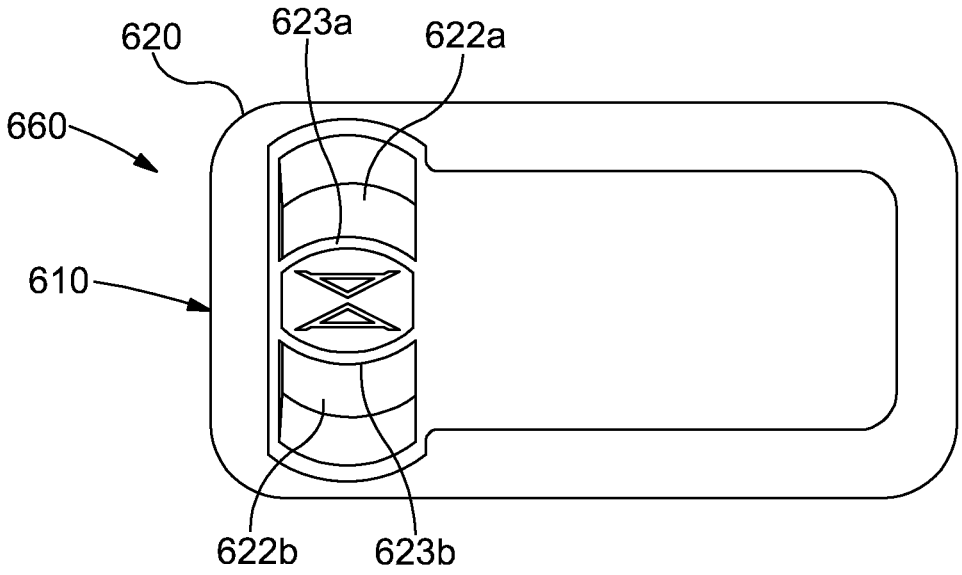
Figure 30:
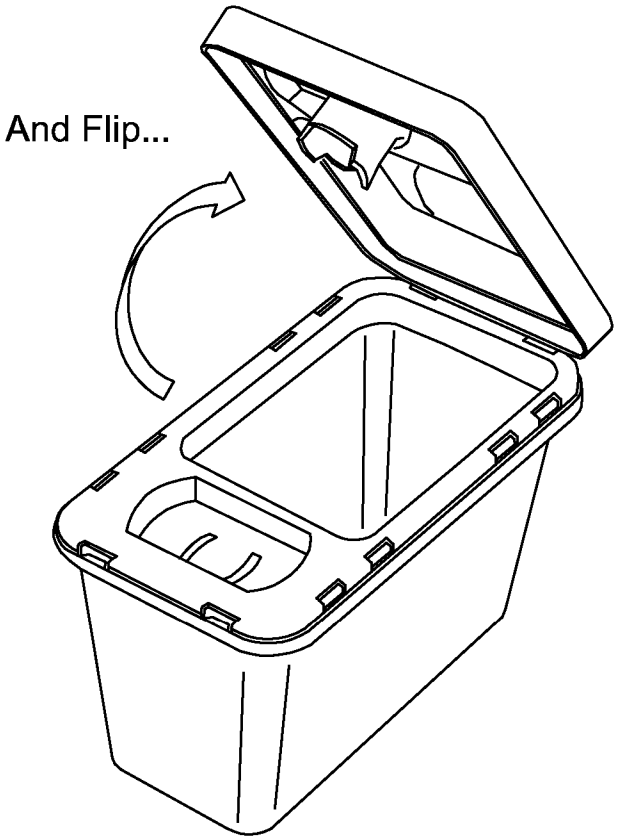
Figure 29:
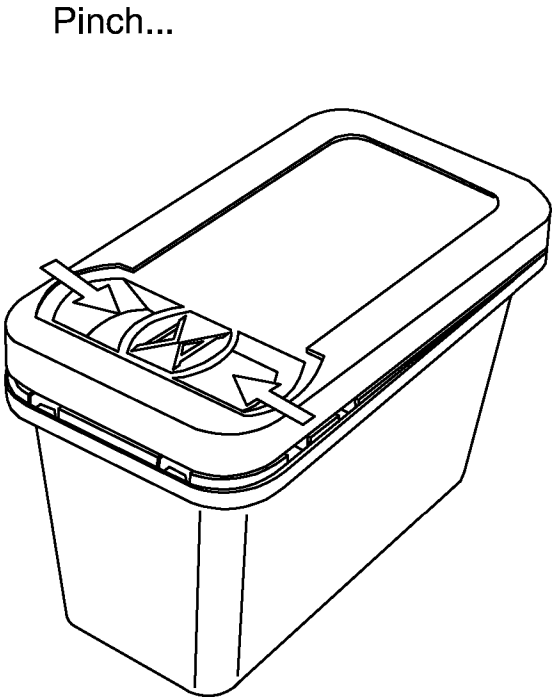

The squeeze force is therefore applied across the longer dimension of the lid to release the lid so that it can be opened as shown in FIGS. 25 and 26.

The pack 660 shown in FIGS. 27 to 30 is similar to the pack 560.

In this embodiment the squeeze members 623*a*, 623*b* are oriented 90 degrees from those in the pack 560. This means that a recess 522*a*, 522*b* must be provided adjacent both members for access. The squeeze force is therefore applied across the shorter dimension of the lid.

FIGS. 31 to 34 show a pack 760 formed in accordance with the present invention.

The pack 760 is similar to the pack 660. In this embodiment a tamper-evident label 770 covers the child-resistant mechanism and must be removed before it can be activated. A further label 775 is also applied to the top of the lid. In this embodiment the labels 770, 775 are formed together and a tear line 780 is provided. When the label 770 is removed it tears along the line 780; the label 775 remains and could be used, for example to provide product information and/or marketing/branding.

Figure 36:
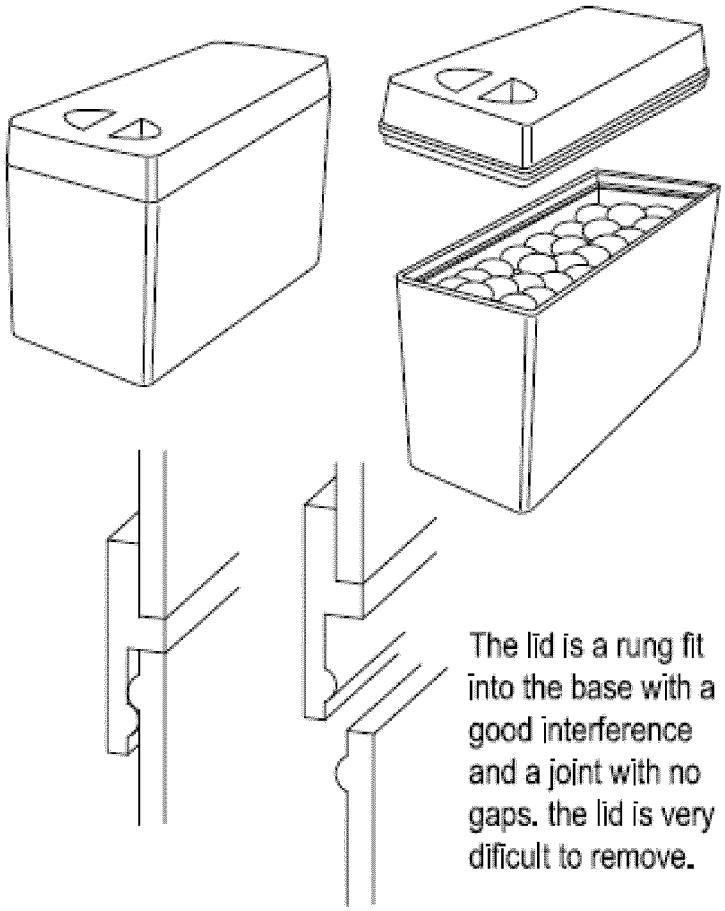
FIGS. 35 and 36 show two different mechanisms by which a lid could be connected to a container.
Figure 35:
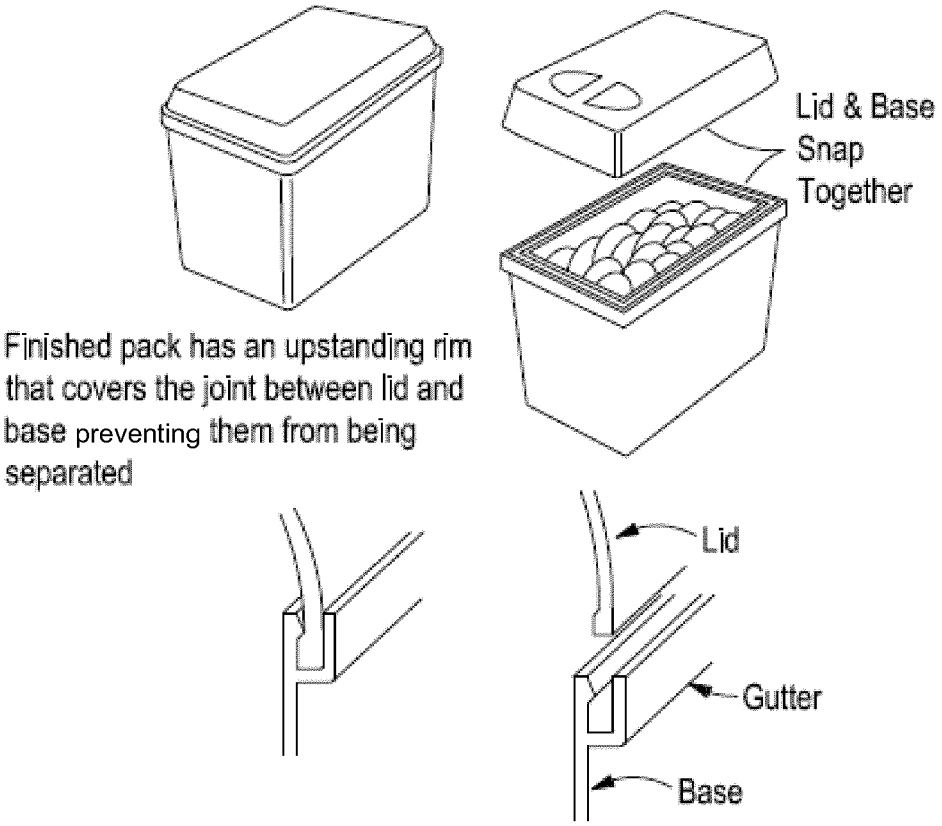

FIGS. 35 and 36 show two different mechanisms by which a lid could be connected to a container.

Figure 37:
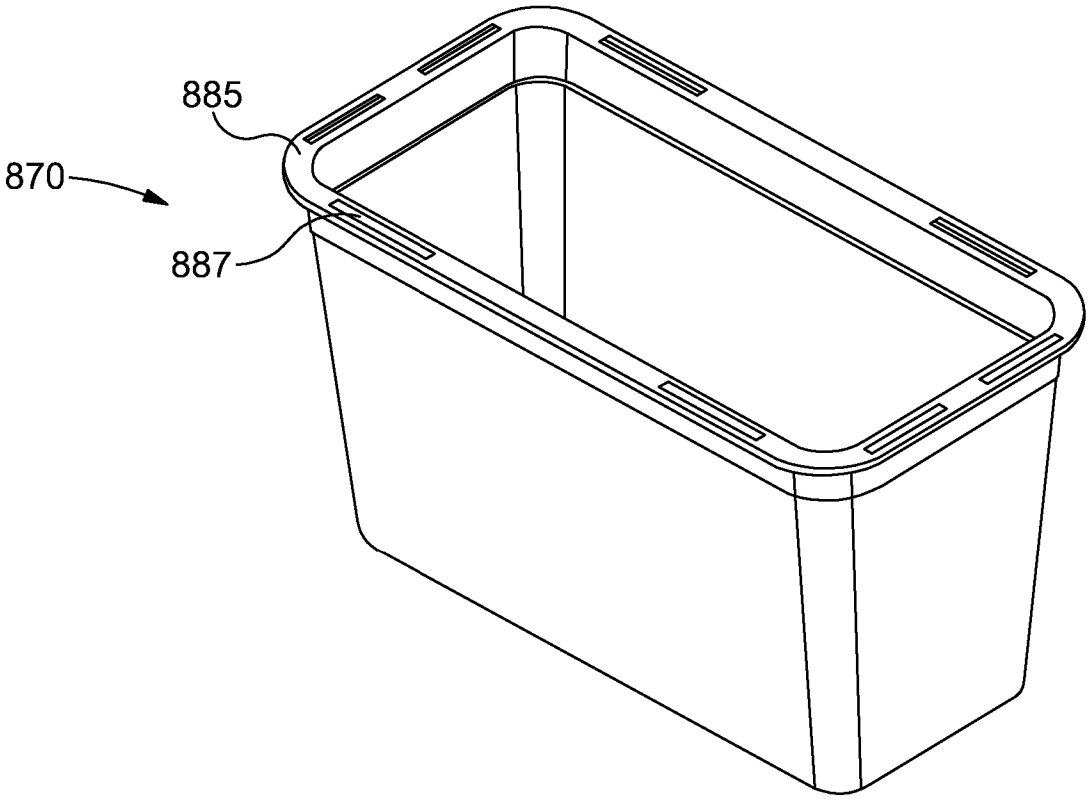
FIG. 37 shows a container including a rim formed with a plurality of retention slots.

FIG. 37 shows a container 870 formed in accordance with the present invention. The container 870 includes a rim 885 formed with a plurality of retention slots 887.

Figure 38:
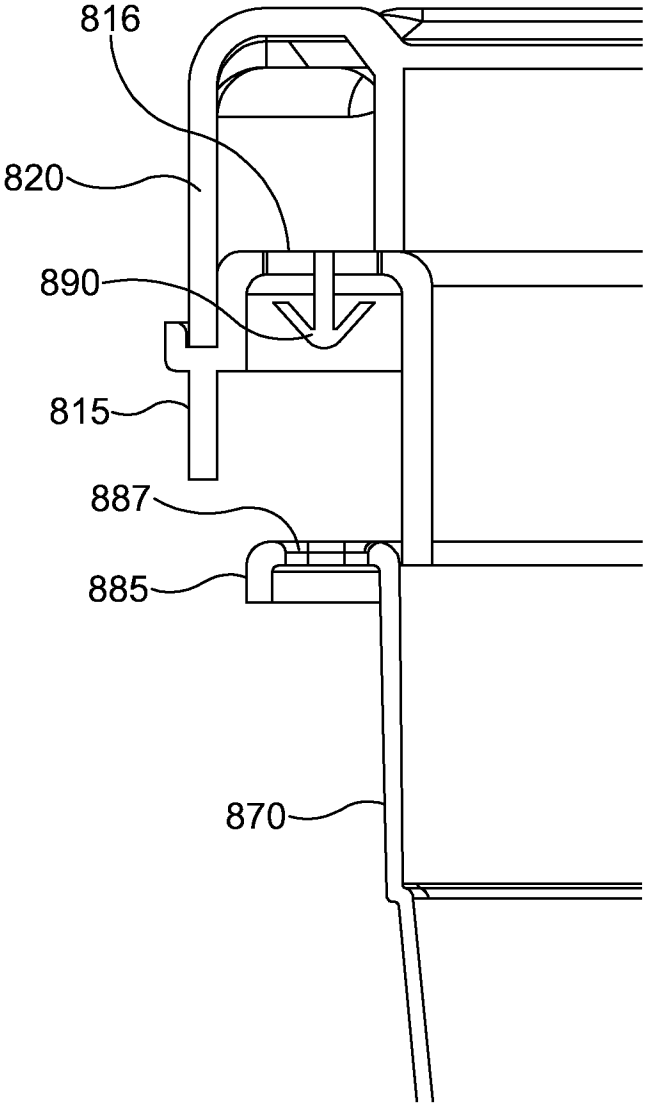
FIG. 38 shows a closure corresponding with the container rim of FIG. 37.

As shown in FIG. 38 a corresponding closure 810 is provided. The closure includes a base 815 and a lid 820. The base 815 includes a rim 816 formed with a plurality if depending catches 890 which are located so as to correspond to the slots 887.

Figure 39:
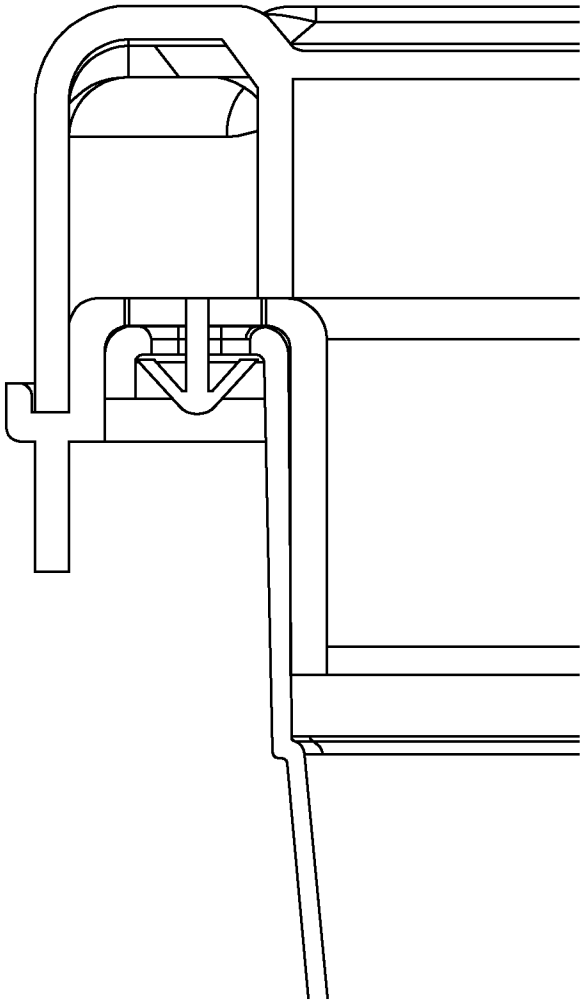
FIG. 39 shows the closure of FIG. 38 stably retained on the container.

Then catches 890 engage in the slots 887 as shown in FIG. 39 to retain the closure 810 stably on the container 870.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A child-resistant closure for a container, the closure comprising;

a lid and a base, the closure comprising child-resistant locking means for preventing unwanted opening of the lid, the locking means comprising two locking members carried on or by a respective release member provided on or by the lid, the locking members engaging the base to prevent opening of the lid, the release members being movable towards each other to disengage the locking members from the base;

wherein the base is non-removably connectable to the container, in that the closure has two shorter sides and two longer sides, in that the lid is connected to the base by a hinge along one of the shorter sides, in that the lid comprises a top plate, the top plate comprises a respective finger recess adjacent the release members so that the release members can be pinched towards each other to disengage the locking members, in that the finger recesses and release members are provided in the top plate and towards the shorter side opposite the hinge, in that the finger recesses and release members together extend across a substantial part of the width of the top plate, and in that the release members are orientated so that a squeeze force is applied across a shorter dimension of the lid.

2. A closure as claimed in claim 1, in which the locking members comprise a pair of lugs.

3. A container comprising a tub and a closure as claimed in claim 1 for the closing the tub.

4. A container and closure as claimed in claim 3, in which the tub and the closure are generally oblong.

5. A closure as claimed in claim 1, in which the finger recesses and release members are covered by a removable sticker or label.

6. A child-resistant household cleaning product pack comprising a container and a closure according to claim 1, the container being a container of the type selected from the group consisting of a storage container, a box or a tub, the container being filled with product selected from the group consisting of a laundry detergent capsule, a dishwasher capsule, a laundry detergent tablet or a dishwasher tablet.

7. A closure as claimed in claim 1, in which the base comprises or is a frame.

* * * * *